US005979709A

United States Patent [19]

Liccioni

[11] Patent Number: 5,979,709

[45] Date of Patent: Nov. 9, 1999

[54] APPARATUS FOR DISPENSING OF LIQUIDS, IN PARTICULAR OF DRINKS

[75] Inventor: Robert Liccioni, Lesigny, France

[73] Assignee: Mistral Distribution, France

[21] Appl. No.: 09/162,623

[22] Filed: Sep. 29, 1998

[30] Foreign Application Priority Data

Sep. 30, 1997 [FR] France ..... 97 12128

[51] Int. Cl.[6] ..... B67D 5/06

[52] U.S. Cl. ..... 222/185.1; 222/189.09; 222/146.6

[58] Field of Search ..... 222/185.1, 189.09, 222/146.6, 207, 212, 481.5

[56] References Cited

U.S. PATENT DOCUMENTS 5,213,597 5/1993 Campbell ..... 222/189.09
5,297,700 3/1994 Burrows et al. .
5,464,127 11/1995 Burrows ..... 222/185.1
5,611,459 3/1997 Hinch .
5,647,416 7/1997 Desrosiers et al. .

FOREIGN PATENT DOCUMENTS

WO 94/18113 8/1994 WIPO .
WO 95/11194 4/1995 WIPO .
WO 95/33165 12/1995 WIPO .

*Primary Examiner*—Philippe Derakshani
*Attorney, Agent, or Firm*—Rudnick & Wolfe

[57] ABSTRACT

This apparatus is characterized by the fact that it comprises an intermediate tank (21) in a single piece of blown food plastic material, connected directly, by a neck 30, on a sleeve 10 of the receptacle 4 which receives the neck 19 of an inserted container R, this sleeve receiving in addition a union 11 enabling the "liquid" and "air" communication between the container R and the tank 21. The tank 21 comprises a lower supple part 25 received in a cooling tray 28, and an upper more rigid part 26 separated from the previous by a constriction section 24 reducing the thermal bridge between these two parts.

14 Claims, 5 Drawing Sheets

APPARATUS FOR DISPENSING OF LIQUIDS, IN PARTICULAR OF DRINKS

The present invention concerns an apparatus for the dispensing of liquids, in particular of drinks, of the type including:

a casing provided with at least side walls and an upper wall, including means for mounting a receptacle in the shape of a flange suitable for receiving the neck of an inverted container containing the liquid to dispense, at least an intermediate tank suitable to be connected to the means of treating the aforesaid liquid such as a heating, a cooling or a gasification system, means of inflow of external air into the upper part of the aforesaid intermediate tank, an outlet union passed through along its length by at least a "liquid" channel, this union being suitable for penetrating into the aforesaid neck of the inverted container and for ensuring in this way of putting this container in communication with the aforesaid intermediate tank, and at least a tap accessible from the outside and mounted on an outlet pipe connected to the aforesaid intermediate tank.

It should be able to work in particular as an apparatus intended for the dispensing of cold, hot or ambient temperature drinks in companies or in public places, or even in the dispensing of any other liquid in determined temperature or other conditions. The apparatuses in question are supplied with these drinks or other liquids by containers or carboys of several liters or tens of liters, provided with a neck sealed with a special cap or a cover able to be pierced, the cap being pushed inside the neck, or the cover being pierced, according to the case, by penetration of the aforementioned outlet union into this neck when the container is turned upside down on the apparatus and engaged by its neck on this union. After which the apparatus enables ensuring the dispensing, to the consumers, drinks or other liquids in the form of variable volume amounts but generally corresponding, when it concerns drinks, to the contents of a glass or a cup placed under one of the taps with which the apparatus is provided.

The principle of operation of the known apparatuses is as follows: when the container is turned upside down on the receptacle and engaged by its neck on the aforesaid outlet union, the liquid which it contains can flow through the union "liquid" channel and reach the intermediate tank. A pressure only slightly less than atmospheric pressure can be maintained in the upper part of the inverted container by an air inflow, passing through the same outlet union, from that which has been called higher the "means of inflow of external air into the upper part of the intermediate tank". In order to facilitate the rise of the air into the union, this comprises by preference at least an "air" channel distinct from the "liquid" channel which has been mentioned higher and from which it is separated by a partition extending over the whole length of the outlet union. When the liquid coming from the inverted container reaches in the intermediate tank the level of the lower end of the union "air" channel, the flow stops automatically, as the air is at that time prevented from rising back up the outlet union, the air pressure in the upper part of the inverted container only being able to become less than atmospheric pressure by a value corresponding to the height of the "water column" in the container, a value which consequently decreases as withdrawals occur in the intermediate tank. From this stable state, every opening, by the user, of the tap connected to the intermediate tank through the outlet pipe mentioned higher, enables the decanting of the desired quantity of liquid, the volume withdrawn in this intermediate tank being simultaneously compensated by a corresponding flow of the same volume from the inverted container into the intermediate tank, the level in this latter being maintained, for the reason indicated higher, at the level of the lower end of the outlet union "air" channel. The level of the liquid in the inverted container falls but the pressure above this level, slightly less than atmospheric pressure, is maintained by the air inflow through the union "air" channel, this continuing until the re-establishment of hydrostatic equilibrium, by the closing of the tap.

For hygiene reasons, it is generally provided that the air entering the upper part of the intermediate tank is filtered; in this case, the means of external air inflow into the upper part of the aforesaid intermediate tank comprise a filter. Generally means are also provided enabling the avoidance of the liquid in the inverted container escaping through the means of external air inflow into the upper part of the intermediate tank, in the case where the upper part of the inverted container, for any reason, would present an external air inlet, as would be able to be produced for example in the case where its wall was accidentally cracked; in order to avoid this risk the aforesaid means of external air inflow can be provided with a valve or similar preventing the aforesaid liquid from flowing into the aforesaid means to the outside.

The present invention aims at the creation of an apparatus for the dispensing of liquids, in particular drinks, only by implementing these different operating principles, enabling the resolving of a certain number of problems affecting its achievement, particularly in order to simplify the structure, the manufacture and the maintenance operations of this apparatus.

In particular, certain of the known apparatuses comprise "piping means" connecting the outlet union of the inverted container to the intermediate tank, which means include at least a tube of supple plastic material. Of course, this tube must be connected by one of its ends on the aforesaid union or on a branch pipe communicating with it, and by its other end on a branch pipe inlet of the intermediate tank, which multiplies the installation operations as well as the sealing problems, without counting the hygiene problems, the changes of section at the level of the connections being able to constitute so many bacteria nests.

On the other hand, certain known apparatuses comprise a "unit" in the form of a bowl with several branch pipes and incorporating the aforesaid outlet union, this unit being supported in a removable way by support means provided under the upper wall of the casing. This unit represents also an additional piece, of complicated shape, generally moulded in plastic material, therefore expensive to manufacture, and which is thrown away at the same time as the aforementioned "piping means" and the intermediate tank during maintenance operations.

The present invention enables resolving these first problems by means of an apparatus of the general type defined at the start, characterised in that the aforesaid receptacle in the form of a flange comprises a lower wall passed through by a sleeve receiving the aforesaid outlet union, and in that the aforesaid intermediate tank comprises in its upper part a neck suitable to be engaged in a sealed manner, directly onto the lower end of the aforesaid sleeve.

In this way, the usual "piping means" as well as the removable "unit" in the shape of a bowl with several branch pipes and which incorporates the outlet union is eliminated. The intermediate tank being connected directly to the outlet of the receptacle in the form of a flange, a connection relating to the case where "piping means" are used between the intermediate tank and the inverted container is eliminated.

Another disadvantage of the known apparatuses resides in the design of the intermediate tank, and appears above all when the liquid must be withdrawn at different temperatures. It is in this way, particularly, in the case of apparatuses for the dispensing of cold, hot and possibly ambient temperature drinks, these apparatuses comprising then, of course, corresponding taps. In order to be able to dispense cold liquids it is known to provide in the apparatus casing a tray provided with cooling means, for example the evaporator coil of a compression refrigeration circuit, this tray receiving the intermediate tank, then surrounded tightly by the coil. The cold liquid is then extracted from the intermediate tank through an outlet pipe emerging near its bottom, in the zone where its temperature is the lowest. The liquid which must be extracted at ambient temperature or needs be heated before being drunk is then evacuated at the uppermost part of the intermediary tank, in the zone where its temperature is the least low. It frequently results that this liquid is still too cold for the consumers who desire a drink at ambient temperature, and that its heating system, when it must be consumed hot, requires a larger expenditure of heat.

An apparatus conforming to the present invention enables also the avoidance of these disadvantages and to this end is also characterised in that the aforesaid intermediate tank is in a plastic material shaped preferably by blowing a piece and comprises in its upper part a relatively rigid wall, and a relatively supple lower part, suitable to be engaged in a cooling tray, these parts being separated from each other by a constriction of the transverse section, which constriction should be able to be surrounded by a thermal insulating material.

This intermediate tank is advantageously of elongated form, the dimension of its transverse section being many times less than its height.

The cold liquid will be then withdrawn in the lower part of the intermediate tank, through a pipe emerging near its bottom, and the liquid having to be withdrawn at ambient temperature or halving to be withdrawn before heating will be able to be removed from the upper part of the intermediate tank, above the constriction, with the advantage that the difference between the temperatures of the liquid in the lower and upper parts of the intermediate tank will be particularly more significant, as a result of the constriction section reducing the thermal bridge, than this is the case in the known apparatuses having an intermediate tank with constant section and having a compact shape.

Other layouts of the invention, concerning particularly the means for external air inflow in the upper part of the aforesaid intermediate tank, as well as other details of design and construction, will be seen lower, in the description, given as an unlimited example, of an apparatus for the dispensing of liquids, in particular of drinks, in accordance with the invention, this description being made with reference to the figures of the appended drawing in which.

Figure 1:
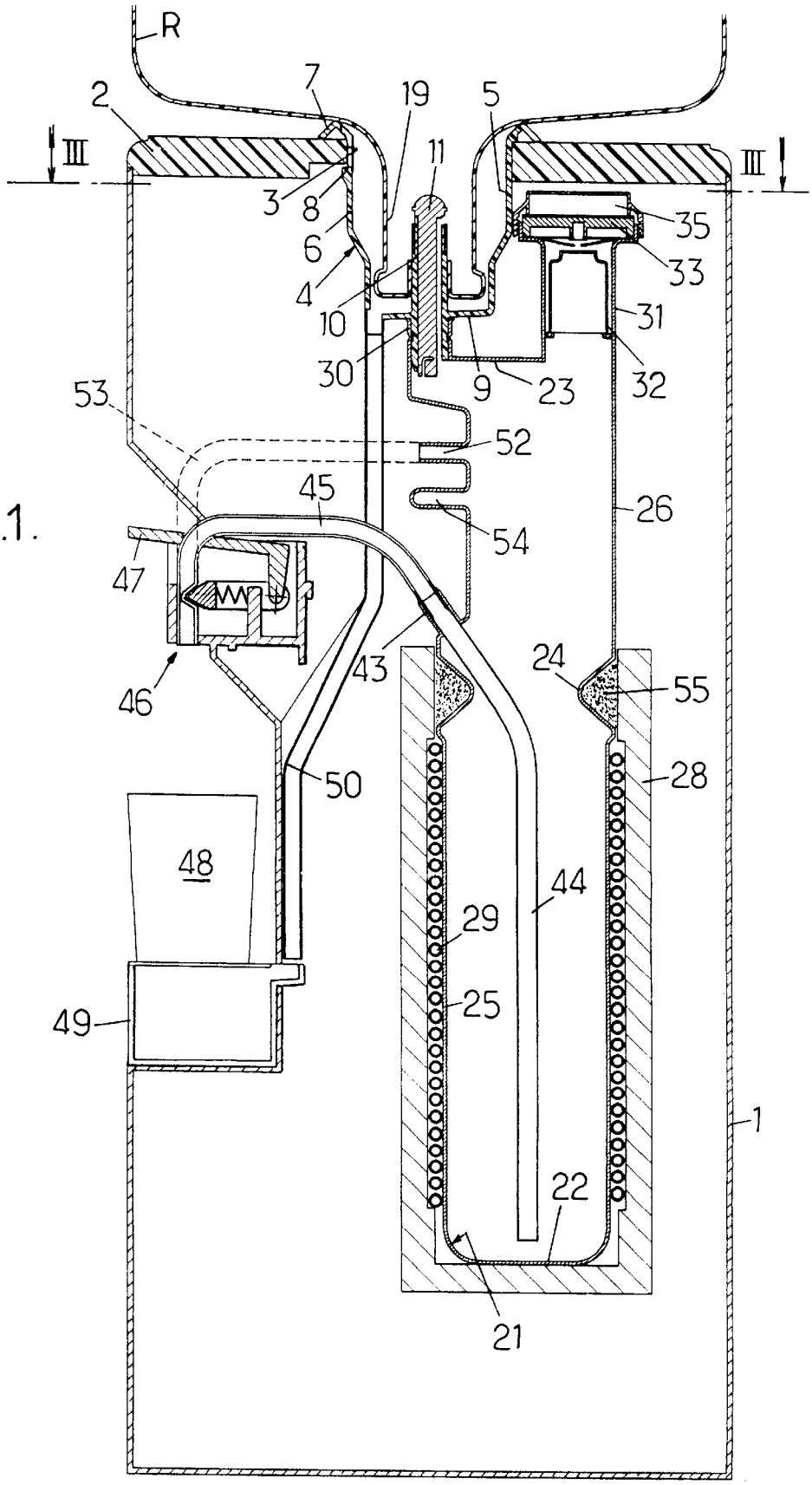
FIG. 1 is a diagrammatic whole view of the apparatus with partial axial sections.

On the figures the casing forming the apparatus chassis, for example in sheet steel, has been referenced 1, its upper wall being constituted from a circular plate 2 provided in its centre with an opening 3 also circular. This opening thus constitutes a means of simple mounting for a receptacle in the shape of a flange 4, for example in rigid moulded plastic material, which comprises for example, projecting on its external cylindrical wall 5, three elastic moulded tabs 6. Thus, the receptacle 4 can be secured, in a detachable manner, to the upper wall 2 of the casing 1, after having been introduced into the opening 3, by clamping the wall 2 between an upper circular shoulder 7 of the receptacle and the upper part 8 of its tabs 6, clipped under the perimeter of the opening 3 (see FIGS. 1 and 2).

Figure 2:
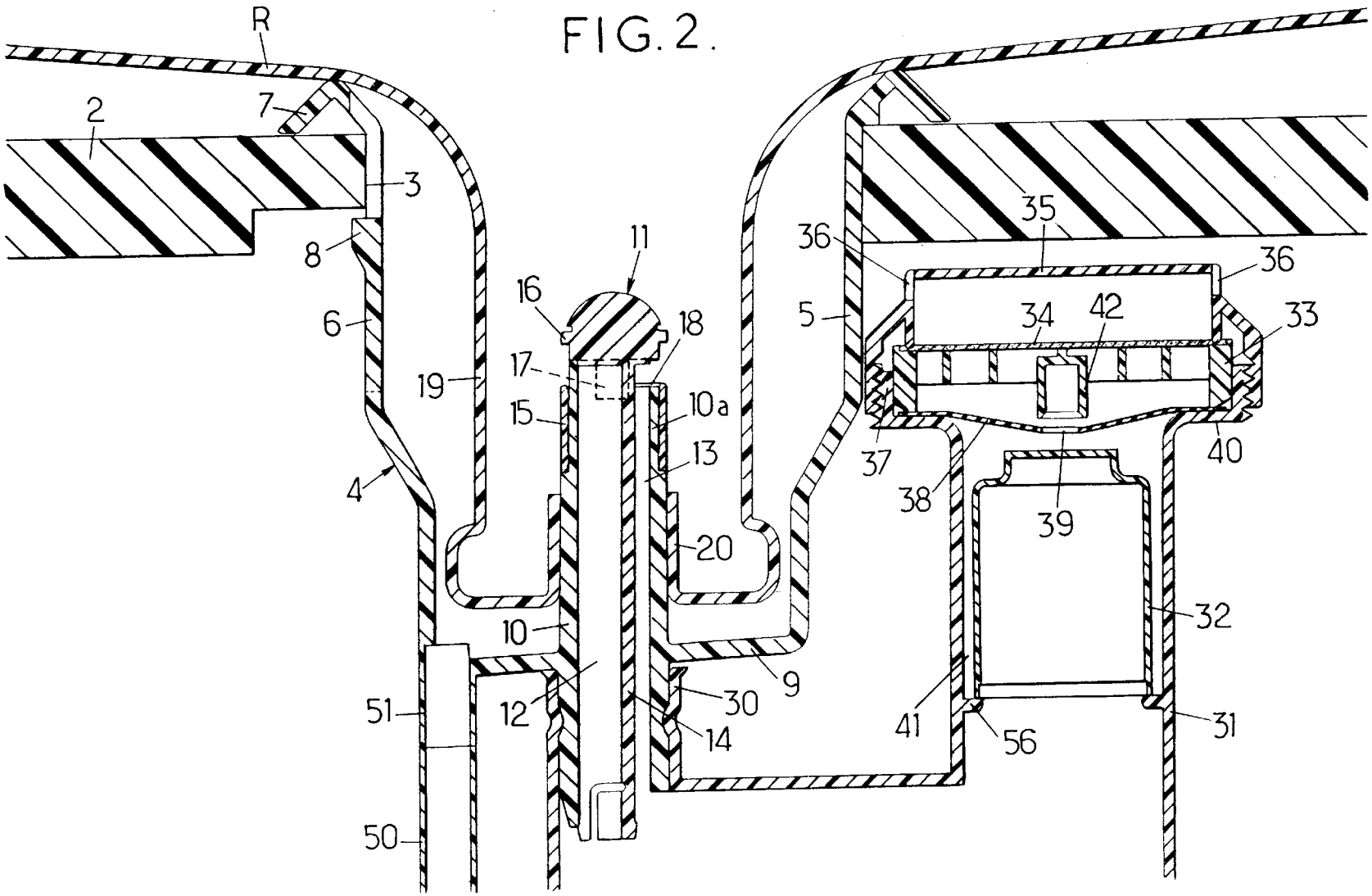
FIG. 2 is a larger scale partial axial section view at the level of the outlet union and of the means for the external air inflow in the upper part of the aforesaid intermediate tank.
Figure 3:
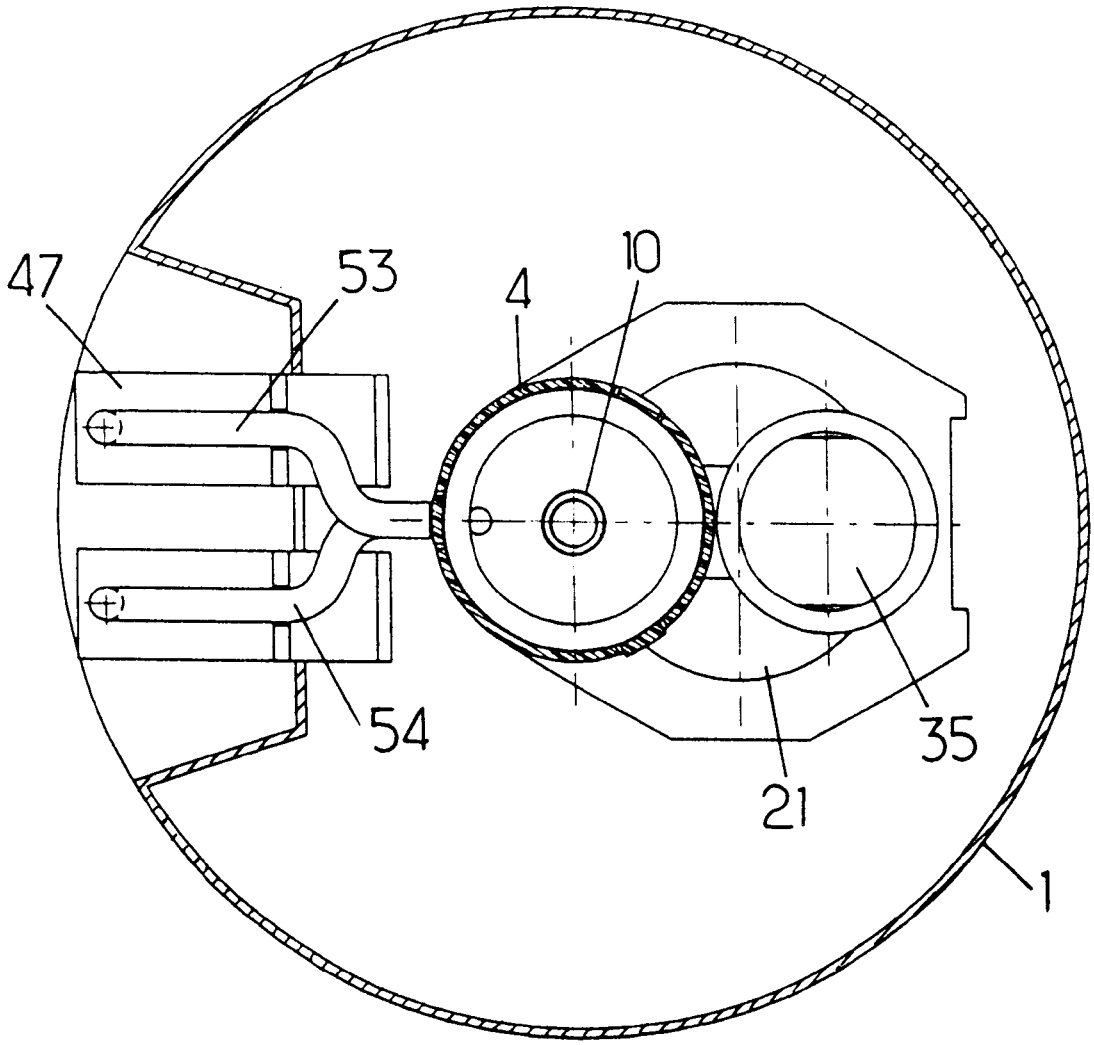
FIG. 3 is a top view, with a section along the line III—III of FIG. 1.
Figure 4:
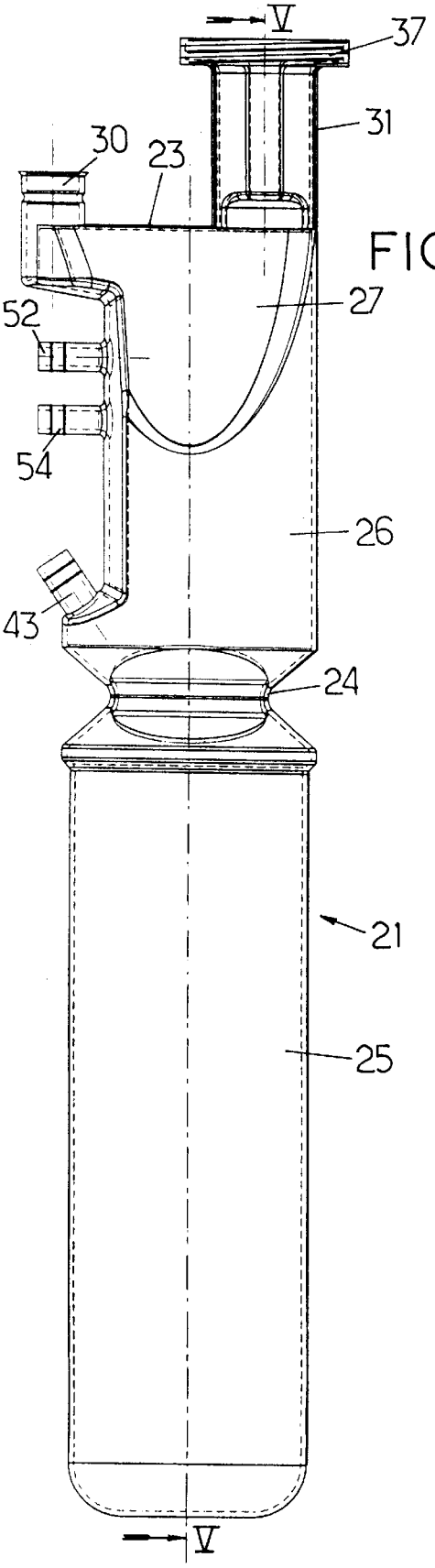
FIG. 4 is an elevation view of the intermediate tank

The lower wall 9 of the receptacle 4 is passed through by a sleeve 10 also moulded and in which is fitted an outlet union 11 passed through practically all its length by a "liquid" channel of large section 12 separated from one or several "air" channels of smaller section 13 by a partition 14 (see FIG. 2). Reference 15 shows a socket sliding mounted in the upper part of the union 11 and which, before placing the inverted container R, is supported under a circular rib 16 in the union head, this for sealing the inlet 17 for the liquid as well as the air outlet 18, in order to prevent the introduction there of pollutants; this socket 15 is pushed downwards, onto the upper narrowed part 10*a* of the sleeve 10, when the neck 19 of the recipient R is inverted on the receptacle 4, by the action of a re-entrant edge 20 of the neck 19 at the instant where this edge is passed through, from bottom to top, by the sleeve 10. It is to be noted that at the same time the cover (not shown) is pierced which, before placing the recipient R, seals the end of its neck 19.

The intermediate tank, in food quality plastic shaped to advantage by blowing of a piece, has been referenced 21. It is particularly elongated in height, i.e. from its bottom 22 to its upper wall 23, its transverse section, in the example shown, being approximately the fifth of its height between walls 22 and 23. At more or less $3/5^{th}$ of this height (as an indicative example), the tank 21 comprises a constriction of section 24 which divides it into a lower part of practically cylindrical shape 25 and an upper part 26 the shape of which corresponds overall to that of a cylinder presenting at its upper end inclined cants 27, this to ensure its ease of placing by reducing its size.

Figure 5:
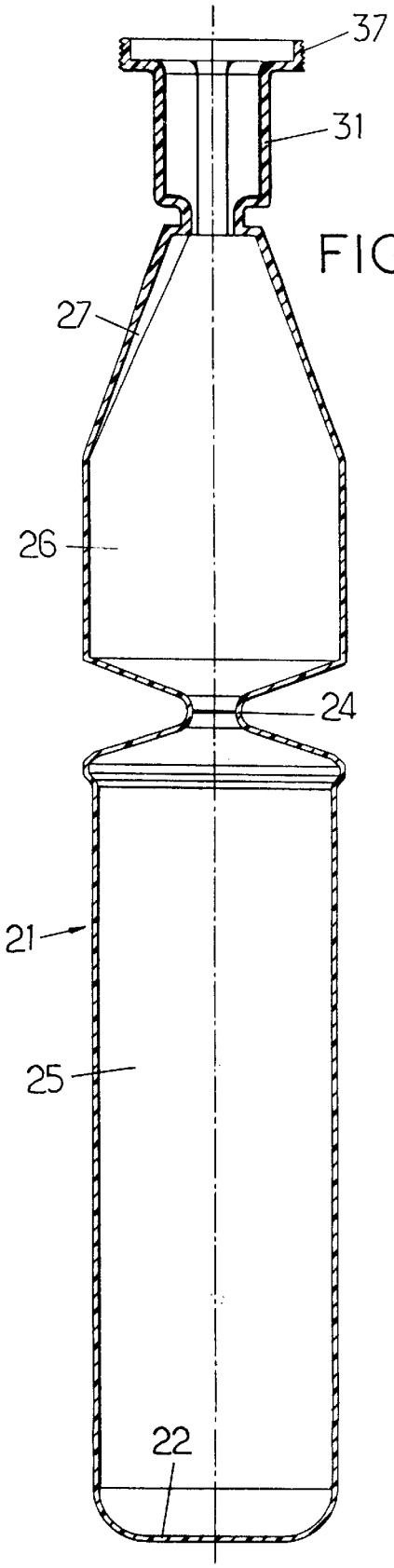
FIG. 5 is a section view of the intermediate tank along the line V—V of FIG. 4.
Figure 6:
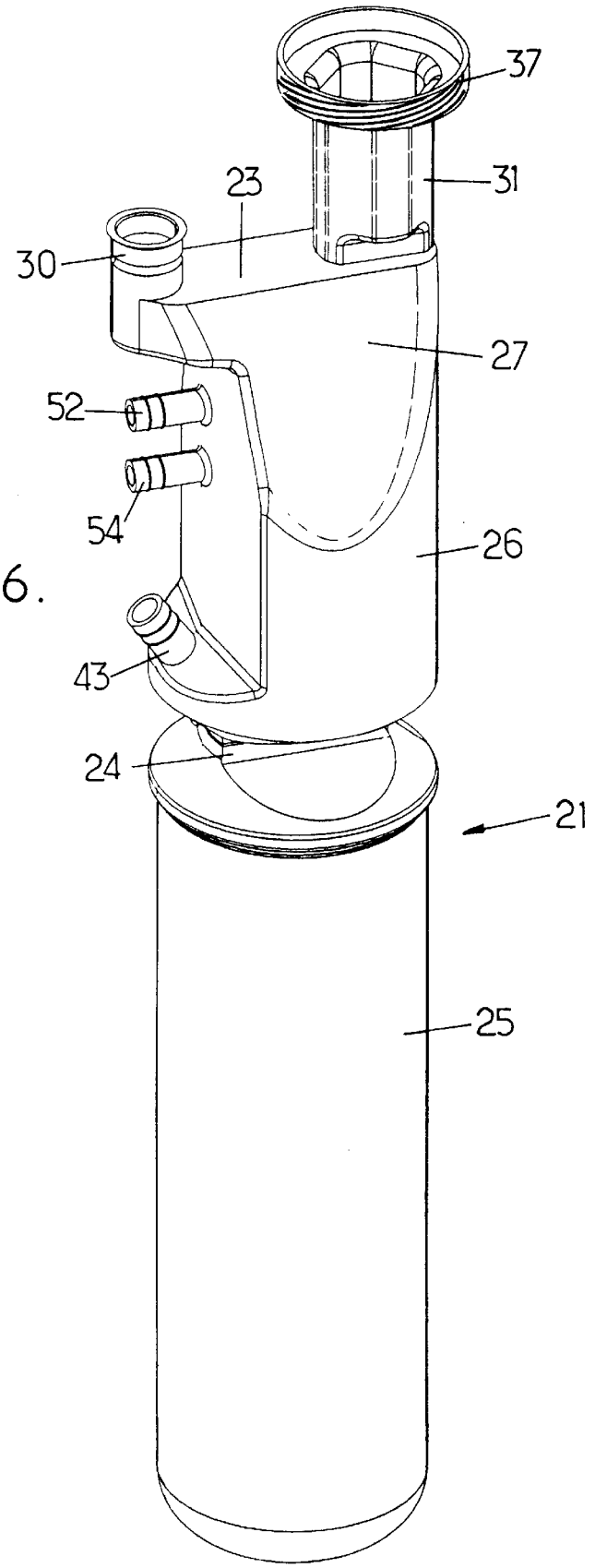
FIG. 6 shows the intermediate tank in perspective.

The manufacture of the intermediate tank 21 in plastic advantageously shaped by blowing enables giving it a non uniform wall thickness, more significant in its upper part 26 than in its lower part 25, as can be seen on FIG. 5, this in order to give it more rigidity in the upper part provided with different pipe branches, than in the lower part, which would be able in this way to be more easily introduced, after folding at the level of the constriction 24, in a rigid cooling tray 28 (FIG. 1), the internal wall of which is covered with an evaporator coil 29 (the compressor refrigeration circuit to which this coil is connected, well known in itself, is contained in the lower part of the casing 1 but has not been shown).

This being so, and the section constriction 24 being situated then at the upper limit of the cooled volume, it can be seen that an intermediate tank 21 is obtained in which the thermal bridge between the lower part 25 and the upper part 26 has its section very notably reduced at the level of the constriction 24, this enabling to maintain in its upper part a liquid at a plainly higher temperature than that of the cooled liquid in its lower part 25, this remedying in a radical manner the disadvantages mentioned higher.

It is to be noted that the thermal insulation between the lower and upper parts of the tank 21 is also improved by the presence of a static air plug round the constriction 24, this air being confined between this constriction and the upper part of the insulating wall of the rigid cooling tray 28, the wall of sufficient height to surround the constriction.

Filling of this space by a thermal insulating material such as foam, referenced by 55 can also be envisaged.

The top of the relatively rigid upper part 26 comprises, as indicated before, different branch pipes.

It comprises in particular a neck 30 engaged in a sealed manner, it being possibly clipped there, on the lower end of the sleeve 10 of the receptacle 4, this ensuring a direct connection between the outlet union 11, therefore between the contents of the container R, and the upper part 26 of the intermediate tank 21, eliminating in this way all "piping means" with supple tubes of the previous art; it comprises in addition, as integral part, a pipe 31 serving at the same time as a guide for a float 32 and as a support for the filtering means of the air likely to enter into the intermediate tank 21 through that which has been called higher the "means of external air inflow in the upper part of the aforesaid intermediate tank". These latter means include a support grille 33 for an interchangeable filtering plate 34 having a relatively significant surface, which plate is held against the grille by a cover 35 provided with lateral blowholes 36 and which would be able to be engaged by force, but is preferably screwed, on the upper widened section part 37 of the pipe 31. A supple membrane 38, for example in silicone, provided with a central hole 39, is clamped by its peripheral edge between the grille 33, housed in the aforesaid widened part, and a support shoulder 40 of the pipe 31, such that in the normal operating position, the air can pass from the outside into the intermediate tank 21 by passing through the blowholes 36, the filter 34, the grille 33, the membrane hole 39 and the peripheral space 41 arranged between the float 32 and the internal wall of the pipe 31, after which the air can rise in the container R through the channel 13 of the union 11, whereas the liquid is drained off through the channel 12.

On the other hand, in the case of air leakage into the upper part of the container R, causing a rise of the liquid level in the intermediate tank 21, the float 32, previously at rest on lugs 56 of the pipe 31, rises in this pipe, and applies the perimeter of the hole 39 of the membrane 38 against a support seat 42 of the grille 33, this ensuring the confinement of the liquid under the membrane and preventing leakage to the outside after having passed through the filter.

It is noted here that if need be the float 32 could be dispensed with, the pressure of the air in the pipe 33 in case of risen back liquid being sufficient to cause the application of the perimeter of the hole 39 of the membrane 38 against the seat 42, at least when this hole is of reduced diameter. As for the fact that the aforementioned blowholes 36 of the cover 35 are lateral, this enables decreasing the kinetic energy of the dusts and of the air before it can pass the filter, this improving the effectiveness of the filtering and avoiding as well the filter receiving directly the dust or insect excretions; the relatively significant surface of the filter participates also in improving the filtering by decreasing the speed of the dust and of the air which passes through it when the liquid is withdrawn from the intermediate tank.

The cover 35 screwed, for example by a "quarter turn" screwing down, on the widened part 37 of the pipe 31 brings in addition the advantage of enabling to clamp firmly the edge of the filter 34 against the peripheral edge of the grille 33, just as the peripheral edge of the membrane 38 is against the shoulder 40, which ensures perfect sealing and prevents the air from penetrating into the tank 21 without having passed through the filter.

The top of the relatively rigid upper part 26 of the intermediate tank 21 comprises also three branch pipes 43, 52 and 54. The lower branch pipe 43 is extended downwards, inside the lower more supple part 25 of the intermediate tank, by a tube 44 emerging near the bottom 22, this in order to withdraw the fresh liquid. On this branch pipe 43 is connected the end of an outlet pipe 45 the other end of which can be sealed or free, in a known manner, by a nipping tap 46 without contact with the liquid, with a control lever 47. The fresh liquid can then be recovered by the consumer in a cup 48 placed on a drip tray 49. In this tray in addition ends a pipe 50 connected on a branch pipe 51 of the lower wall 9 of the receptacle 4, so as to recover the leaks able to be produced between the union 11 and the re-entrant edge 20 of the neck 19 of the inverted container R, particularly during putting into service. As for the upper branch pipe 52, it enables the withdrawal of the liquid at a temperature close to ambient in the upper part 26 of the intermediate tank and can therefore be connected directly, through an outlet pipe 53, to another tap similar to the tap 46. Finally, the third branch pipe 54 can also enable the withdrawal, in the upper part 26 of the intermediate tank, of the liquid at a temperature close to ambient and offering it to the consumer's choice after a treatment such as a gasification or a heating.

When it is desired to replace the tank 21 by another, this can be done very easily by disconnecting the pipes 45 and 53 from their respective taps, by disconnecting the pipe 50 from the receptacle 4, and by disconnecting the neck 30 of the intermediate tank from the lower end of the sleeve 10, after which it is sufficient to extract the receptacle 4 by the top by unlocking the elastic tabs 6 through the underneath of the wall 2, then extracting the whole of the intermediate tank 21 and its filtering means.

The replacing of another intermediate tank is carried out by means of the operations of placing the tank in the casing, the clipping of the receptacle 4 on the wall 2 and then connecting the different aforementioned branch pipes, carried out in the reverse order to that of the dismantling operation.

I claim:

1. An apparatus for the dispensing of liquids, in particular of drinks, of the type including:

a casing (1) provided with at least lateral walls and an upper well (2), including means of mounting (3) for a receptacle (4) in the shape of a flange suitable for receiving the neck (19) of an inverted container (R) containing the liquid to dispense, at least an intermediate tank (21) suitable to be connected to means of treatment of the aforesaid liquid such as a heating, cooling (29) or a gasification system, means (33 to 41) for the inflow of external air into the upper part of the aforesaid intermediate tank (21), an outlet union (11) passed through along its length by at least a "liquid" channel (12), this union being suitable to penetrate into the neck (19) of the inverted container (R) and to ensure in this way of putting into communication this container with the aforesaid intermediate tank (21), and at least a tap (46) accessible from the outside and mounted on an outlet pipe (45) connected to the aforesaid intermediate tank (21), characterised in that the aforesaid receptacle (4) in the shape of a flange comprises a lower wall (9) passed through by a sleeve (10) receiving the aforesaid outlet union (11), and in that the aforesaid intermediate tank (21) comprises in its upper part a neck (30) suitable to be engaged in a sealed manner, directly onto the lower end of the sleeve (10).

2. An apparatus in accordance with claim 1, characterized in that the aforesaid intermediate tank (21) is in plastic material shaped by blowing a piece and comprises on its upper part (26) a relatively rigid wall, and a relatively supple lower part (25), suitable to be engaged in a cooling tray (28), these parts being separated from each other by a constriction (24) of their transverse section.

3. An apparatus in accordance with claim 2, characterised in that the upper part of the aforesaid cooling tray (28) surrounds the aforesaid constriction (24), so that a plug of air is confined in the space between this constriction and the aforesaid upper part of the tray (28).

4. An apparatus in accordance with claim 2 or 3, characterised in that the space between the constriction (24) of the intermediate tank (21) and the upper part, which surrounds it, of the cooling tray (28) is filled by a thermal insulating material (55).

5. An apparatus in accordance with claim 2, characterised in that the aforesaid intermediate tank comprises on the relatively rigid wall of its upper part (26) a certain number of branch pipes (43, 52, 54), particularly a lower fresh liquid outlet branch pipe (43) connected to an internal tube (44) emerging near the bottom (22) of the aforesaid intermediate tank (21), and at least one upper branch pipe (52, 54) for outlet of liquid at a temperature close to the ambient, emerging in the aforesaid upper part (26).

6. An apparatus in accordance with claim 1, characterised in that the intermediate tank (21) is of elongated form, the dimension of its transverse section being several timers less than its height.

7. An apparatus in accordance with claim 1, characterised in that the aforesaid intermediate tank (21) has at the end of its upper part (26) inclined cants (27).

8. An apparatus in accordance with claim 1, characterised in that the upper part (26) of the intermediate tank (21) comprises as an integral part a pipe (31) serving as a support (40) for the filtering means (33, 34) which comprise the aforesaid means (33 to 41) of external air inflow.

9. An apparatus in accordance with claim 8, characterised in that the aforesaid pipe (31) comprises an upper part with a widened section (37) receiving a support grille (33) for a filtering plate (34) having a relatively significant surface.

10. An apparatus in accordance with claim 9, characterised in that a membrane (38) comprising a central hole (39) is clamped by its peripheral edge between the aforesaid grille (33) and a support shoulder (40) of the aforesaid pipe (31), the arrangement being such that in case of rise of the liquid in the aforesaid pipe (31), the aforesaid central hole (39) is sealed by application of its perimeter against a support seat (42) of the aforesaid grille (33).

11. An apparatus in accordance with claim 10, characterised in that the aforesaid pipe (31) constitutes also a guide for a float (32), the arrangement being such that in case of rise of the liquid in the aforesaid pipe (31), the consecutive rise of the aforesaid float causes the application of the perimeter of the aforesaid central hole (39) of the membrane (38) against the support seat (42) of the aforesaid grille (33).

12. An apparatus in accordance with claim 10 or 11, characterised in that the aforesaid upper part with widened section (37) is sealed by a screwed cap (35) causing the clamping, on the one hand of the peripheral edge of the filtering plate (34) against the grille (33), and on the other hand the clamping of the peripheral edge of the membrane (38) against the aforesaid support shoulder (40).

13. An apparatus in accordance with claim 12, characterised in that in order to enable the inflow of the external air towards the aforesaid filtering plate (34), the aforesaid cap (35) comprises lateral blowholes (36).

14. An apparatus in accordance with claim 1, characterised in that the aforesaid receptacle in the shape of a flange (4) comprises elastic tabs (6) suitable to be clipped under the edge of an opening (3) of the upper wall (2) of the aforesaid casing (1) when the aforesaid receptacle has been introduced into this opening.

* * * * *